US009694961B2

(12) United States Patent
Grinwald et al.

(10) Patent No.: US 9,694,961 B2
(45) **Date of Patent: *Jul. 4, 2017**

(54) METHOD OF USING A CORNER BOARD PROTECTOR

(71) Applicant: All About Packaging Inc., Appleton, WI (US)

(72) Inventors: Brent J. Grinwald, Appleton, WI (US); Craig A. Olson, Appleton, WI (US)

(73) Assignee: All About Packaging, Inc., Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,489

(22) Filed: Feb. 23, 2016

(65) Prior Publication Data

US 2016/0280444 A1 Sep. 29, 2016

Related U.S. Application Data

(60) Division of application No. 14/267,805, filed on May 1, 2014, now Pat. No. 9,272,832, and a continuation of application No. 13/679,589, filed on Nov. 16, 2012, now Pat. No. 9,382,054.

(60) Provisional application No. 61/818,793, filed on May 2, 2013.

(51) Int. Cl.
*B65D 81/05* (2006.01)

(52) U.S. Cl.
CPC ..... *B65D 81/054* (2013.01); *B65D 2581/051* (2013.01); *B65D 2581/053* (2013.01); *B65D 2581/055* (2013.01); *Y10T 29/49826* (2015.01)

(58) Field of Classification Search
CPC ..... B65D 81/054; B65D 2581/055; B65D 2581/053; B65D 2581/051; Y01T 29/49826
USPC ..... 206/386, 597, 497, 593, 586; 108/55.1, 108/55.5; 29/428
See application file for complete search history.

(56) References Cited

U.S. PATENT DOCUMENTS

| | | | |
|---|---|---|---|
| 1,200,467 | A | 10/1916 | Cady |
| 2,328,397 | A | 8/1943 | Neuman |
| 3,416,652 | A | 12/1968 | Almasy |
| D220,166 | S | 3/1971 | Griffith |

(Continued)

OTHER PUBLICATIONS

Photos submitted in an IDS for U.S. Appl. No. 13/479,083, and received by a third party. Date submitted Dec. 26, 2014, 3 pgs.

*Primary Examiner* — Steven A. Reynolds
(74) *Attorney, Agent, or Firm* — Northwind IP Law, S.C.; Thomas J. Connelly

(57) ABSTRACT

A method of using a corner board protector including the steps of positioning a one piece, corner board locator having a connection portion, having an angled slot formed therein, and an insert portion, having a single continuous planar exterior edge with a tip, on a corner board having two angled panels. The two angled panels engage with the angled slot to retain the corner board locator at a select height along the corner board. The corner board and the corner board locator are positioned adjacent to a stack of at least two vertically consecutive containers. The tip of the single continuous planar exterior edge is slid between two of the at least two vertically consecutive containers to form a corner board protector.

6 Claims, 15 Drawing Sheets

(56) References Cited

U.S. PATENT DOCUMENTS 3,776,145 A * 12/1973 Anderson ..... B65D 19/36 108/51.3
3,955,677 A 5/1976 Collingwood
4,078,673 A 3/1978 Wilhelmi
4,148,394 A 4/1979 Bederman
4,201,138 A 5/1980 Cox
4,265,184 A 5/1981 Cox
4,292,901 A * 10/1981 Cox ..... B65D 71/0096 108/55.1
5,115,917 A 5/1992 Schrage
5,161,692 A * 11/1992 Knierim ..... B65D 5/32 206/320
5,161,693 A 11/1992 Friman
5,251,753 A 10/1993 Pigott et al.
5,339,957 A * 8/1994 Carstens ..... B65D 21/0224 106/36
5,624,031 A 4/1997 Fowler et al.
5,772,037 A * 6/1998 Hurley ..... B65D 81/054 206/586
6,012,587 A * 1/2000 McCullough ..... B65D 71/0096 206/453
6,499,626 B1 12/2002 Julius
6,685,021 B2 2/2004 Dodson et al.
6,971,518 B1 12/2005 Lowry
D660,454 S * 5/2012 Lavelle ..... D24/227
8,231,004 B2 7/2012 Port et al.
D709,360 S * 7/2014 Lavelle ..... D8/403
8,910,790 B2 * 12/2014 Trickett ..... B65D 71/0088 206/497
9,272,832 B2 * 3/2016 Grinwald ..... B65D 81/054
9,382,054 B2 * 7/2016 Grinwald ..... B65D 81/054
2005/0269229 A1 * 12/2005 Lowry ..... B65D 19/385 206/386
2005/0284783 A1 12/2005 May, Jr.
2009/0029130 A1 * 1/2009 Stubing ..... B65D 81/053 428/213
2009/0032432 A1 2/2009 Kostos et al.
2011/0180450 A1 7/2011 Hainer
2011/0293398 A1 12/2011 Leibreich et al.
2013/0032506 A1 2/2013 Grenchus et al.
2014/0238893 A1 8/2014 Grinwald et al.

* cited by examiner

METHOD OF USING A CORNER BOARD PROTECTOR

CROSS-REFERENCE TO RELATED PATENT APPLICATIONS

The present application is a Divisional application and claims priority to U.S. Ser. No. 14/267,805, filed May 1, 2014 and entitled: PALLET CORNERBOARD LOCATOR, which is taken claimed priority to U.S. Provisional application Ser. No. 61/818,793 filed on May 2, 2013 and entitled: PALLET CORNERBOARD LOCATOR, which claims priority under Section 120 from co-pending U.S. patent application Ser. No. 13/679,589 filed on Nov. 16, 2012 and entitled: PALLET CORNERBOARD LOCATOR, the full disclosure of which is hereby incorporated by reference.

BACKGROUND

Corner boards are sometimes used to protect the corners of containers stacked upon a pallet. Locating and retaining the corner boards in place with respect to the stack of containers prior to shrink wrapping or strapping of the pallet may be difficult.

DETAILED DESCRIPTION OF THE EXAMPLE EMBODIMENTS

Figure 1:
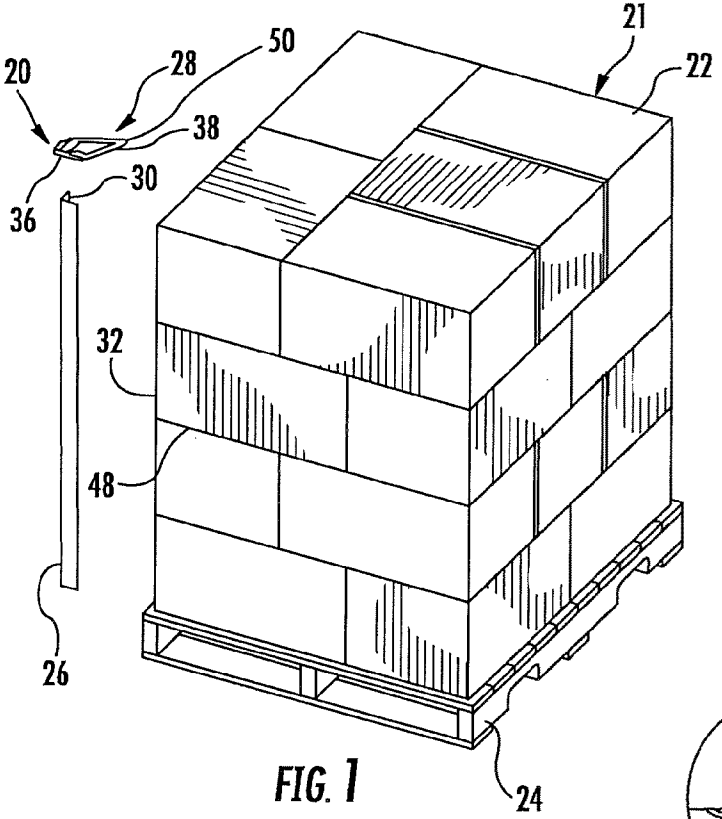
FIG. 1 is a perspective view of an example corner protection system for use with a palletized stack of containers.

FIG. 1 illustrates corner protection system or corner protector 20 for use with a palletized stack 21 of containers 22 resting upon a pallet 24. Corner protector 20 protects the corners of the stack 21 during shipment, storage and display. As will be described hereafter, corner protector 20 is reliably and securely located and retained with respect to stack 21 and containers 22 prior to shrink wrapping or strapping of the containers 22 on pallet 24.

Corner protector 20 comprises corner board 26 and corner board locator 28. Corner board 26 comprises an elongate angled member or structure forming an angled cavity 30 configured to receive a corner 32 of the stack 21 of containers 22. In the example illustrated, corner board 26 has a length sufficient to extend along an entirety of the corner 32 of stack 21. In other implementations, corner board 26 may have a length less than the entire height of corner 32, wherein a portion of the corners of containers 22 may not be protected or wherein corner board 26 may be combined with other corner boards 26 to collectively protect corner 32. In one implementation, corner board 26 is formed from cardboard. In another implementation, corner board 26 may be formed from other materials such as styrofoam, solid, open celled or closed cell polymers, wood, ceramics or other materials.

Corner board locator 28 comprises a member or structure configured to be connected or mounted to corner board 26 so as to project from corner board 26. Corner board locator 28 comprises a corner board connection portion 36 and an insert portion 38. Corner board connection portion 36 comprises that portion of locator 28 configured to mount locator 28 to corner board 26. In the example illustrated, corner board connection portion 36 comprises an angled slot 44 (shown in FIG. 3) extending on and along an end portion of insert portion 38. In the example illustrated, angled slot 44 is a substantially right angled slot to accommodate corner board 26 having substantially right angled panels. In other implementations, slot 44 may have other angles to accommodate a corner board 26 having panels at other angles, or slot 44 may have other angles to create a friction grip or interference fit with corner board 26. Angled slot 44 slidably receives a cross-section of corner board 28 to facilitate adjustable or selectable positioning of locator 28 along the length of corner board 26. As a result, corner protector 20, formed from corner board 26 and locator 28, may accommodate differently located seams, interfaces or cracks 48 which may vary depending upon different heights or different dimensions of different containers 22 or combination of containers 22.

In other implementations, connection portion 36 of locator 28 may have other configurations. For example, in other implementations, connection portion 36 may include a tab, hook or flap insertable into one of a series of spaced open or closed pockets, straps, tab receiving slits, loops, buttonholes or the like formed along the length of corner board 26. In another implementation, connection portion 36 may include a tab or flap having an adhesive having sufficient tackiness to secure and retain locator 28 to corner board 26 at a selected position along corner board 26.

Insert portion 38 comprises a flap, wing, finger, projection or panel extending from connection portion 36. Insert portion 38 extends from connection portion 36 when locator 28 is mounted to corner board 26 such that insert portion 38 also extends or projects from corner board 26 in a direction substantially perpendicular or normal to each of the panels or walls of corner board 26. Insert portion 38 has a thickness so as to project from corner board 26 and to be insertable into contact with an underside of a container 22 on a pallet 24 without substantially elevating or tipping the overlying container 22. In one implementation, insert portion 38 has a maximum thickness less than or equal to 0.25 inch (6.35 millimeters). In one implementation, projection or insertion portion 38 may be inserted into a seam 48 between vertically consecutive packages or containers on pallet 24. In another implementation, projection or insertion portion 38 may be inserted below a lower most container 22 of stack 21 between the lower most container 22 and pallet 24. In some implementations, projection or insertion portion 38 may be located along corner board 26 so as to project on top of, and partially across a topmost package or container 22 of stack 21 on pallet 24. Additionally, projection portion 38 may be fastened to pallet 24 before lower most container 22 is placed on pallet 24. Portion 38 may be fastened to pallet 24 by any means, including adhesive, tape, nail, screw, staple, or rivet. In the example illustrated, insertion portion 38 has a pointed end or tip 50 facilitate insertion below an overlying container 22. In other implementations, insertion portion 38 may have a rounded tip 50, or may have other shapes. In some implementations, tip 50 may be tapered, similar to that of the blade, to facilitate insertion into a seam 48 or insertion between a lowermost container 22 and pallet 24.

Figure 2:
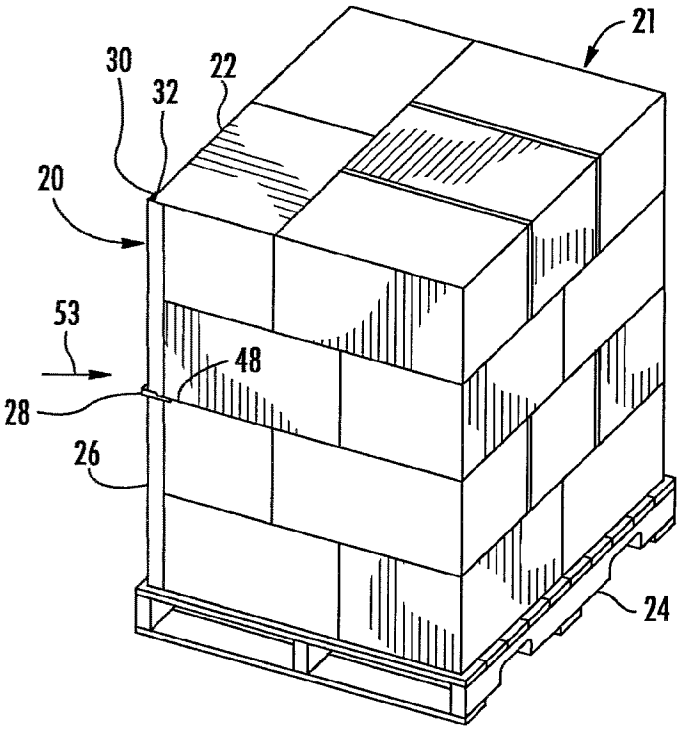
FIG. 2 is a perspective view of the corner protection system of FIG. 1 positioned on the palletized stack of containers.
Figure 3:
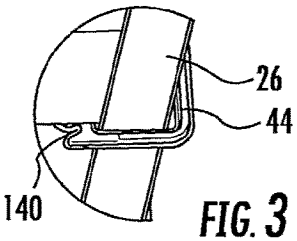
FIG. 3 is an enlarged fragmentary perspective view of the corner protection system of FIG. 2.

FIGS. 2 and 3 illustrate an exemplary use of corner protector 20. As shown by FIG. 3, locator 28 is positioned and secured along corner board 26 at a selected height such that insertion portion 38 will align opposite to seam 48. In the example, corner board 26 is slid through slot 44 of locator 28 until position that a desired location. As noted above, in other implementations, locator 28 may be selectively positioned along corner board 26 in other fashions.

As shown by FIGS. 2 and 3, once locator 28 has been a properly position along corner board 26, corner protector 20 is moved in a substantially horizontal direction (as indicated by arrow 53) towards stack 21 until cavity 30 receives corner 32 with insert portion 38 received within seam 48. Insert portion 38 retains corner board 26 in place relative to corner 32 prior to stack 21 being wrapped or shrink film or being secured with strapping. Insert portion 38 further retains corner board 26 in place after the shrink wrapping or strapping has been removed. The weight of the overlying containers (also known as packages, cartons, boxes, bins, sub pallets, modules and the like) bearing down upon insertion portion 38 provide a friction hold inhibiting accidental or inadvertent withdrawal of insert portion 38. This retention is provided with minimal scratching or damaging of the containers 22.

Although corner protector 20 has been described as comprising a single locator 28 selectively positioned along corner board 26, in other implementations, corner protector 20 may include a plurality of locators 28 along the length of corner board 26. For example, corner protector 20 may include a first locator 28 between pallet 24 and a lowermost container 22 of stack 21, a second locator 28 located above the uppermost container 22 of stack 21 and one or more additional locators 28 inserted into different seams 48 of stack 21.

Although corner protector 20 has been illustrated and described as having one or more locators 28 as being separable from corner board 26 to allow for use of locators 28 with different corner boards 26 having different lengths for different heights of stack 21 and to allow for reuse of locators 28 upon damage to corner boards 26, in other implementations, corner protector 20 may be slidable along corner protector 26, but may be captured between stops, catches, caps or blocking structures located at one or both ends of corner board 26. Although corner protector 28 has been illustrated as having one or more locators that move along corner board 26, in other implementations, locators 26 may be fixed in place relative to corner board 26. For example, in some implementations, locators 28 may alternatively be integrally formed as part of a single unitary body with corner board 28, may be bonded, fastened, welded, or otherwise fixedly connected to corner board 26, wherein connection portion 36 is omitted or the other configurations such that insert portion 38 provides a panel projecting from the pallet corner board 26 to extend beneath and in contact with an underside of a container 22 of a stack 21 of containers 22.

Figure 4:
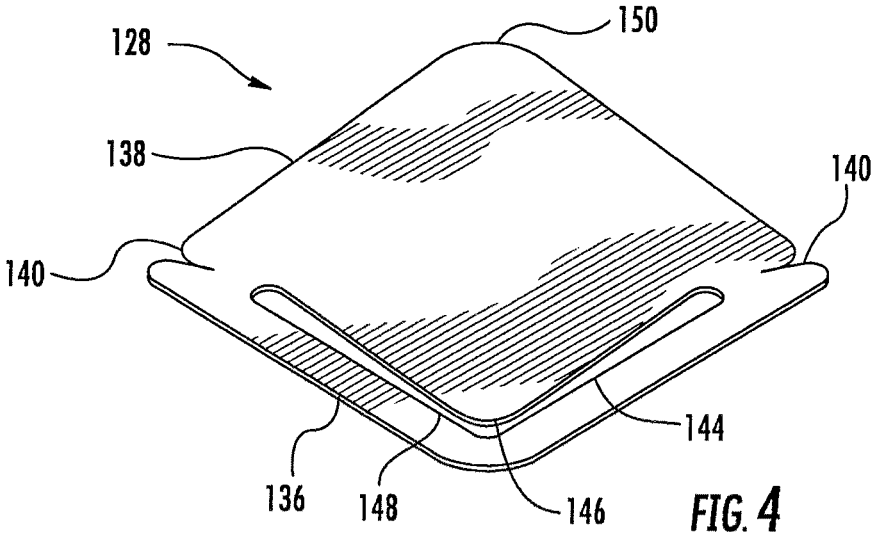
FIG. 4 is a perspective view of an example corner board locator of the corner protection system of FIG. 1.
Figure 5:
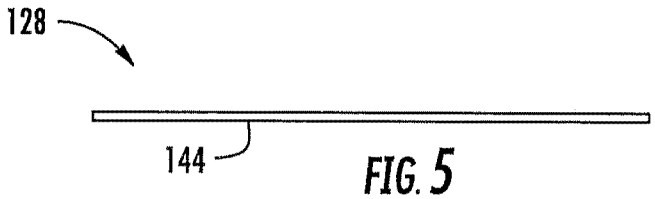
FIG. 5 is a sectional view of the locator of FIG. 4.
Figure 6:
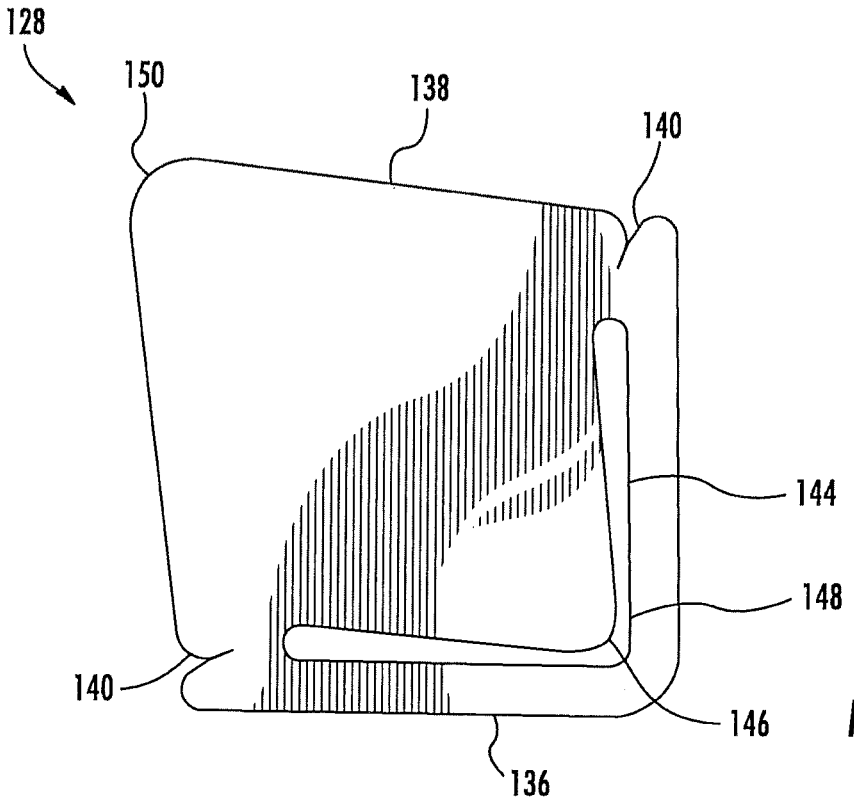
FIG. 6 is a top view of the locator of FIG. 4.

FIGS. 4-6 illustrate locator 128, a particular example of locator 28 shown in FIGS. 1 and 2. Locator 128 comprises connection portion 136, insert portion 138, and hooks 140. Connection portion 136 facilitates connecting locator 128 to corner board 26 (shown in FIG. 1). Connection portion 136 comprises angled slot 144. Slot 144 is similar to slot 44. In the example illustrated, slot 144 has a tapering width towards point 146 to create a pinch point 148. The angle between the sides of slot 144 could be greater than, equal to, or less than the angle between the panels or walls of corner board 26. During insertion of corner board 26 through slot 144, point 146 resiliently flexes to enlarge pinch point 148 to allow sliding movement of corner board 26 through slot 144. Also, the panels or walls of corner board 26 might flex relative to one another to accommodate the acute or obtuse angle of the sides of slot 144. Once locator 128 has been moved to a desired position, point 146 grips the interiors of cavity 30 at or near the concave interior corner of corner board 26 to retain locator 128 in a selected position along corner board 26. Additionally, the sides of slot 144 aid in gripping the exteriors of cavity 30 away from the corner of corner board 26 to retain locator 128 in a selected position along corner board 26. As noted above, slot 144 may have other angles or other dimensions depending upon the angles and dimensions of corner board 26. Insertion portion 138 is similar to insertion portion 38 in that insertion portion 138 is configured to be inserted beneath and in contact with an underside of the container 22 of stack 21 (shown in FIG. 1). As with insertion portion 38, insertion portion 138 includes a point 150, to facilitate such insertion.

Hooks 140 comprise catches, slits, knobs or other structures along insert panel or portion 138 proximate two opposite ends of slot 144. Hooks 140 comprise structures configured to receive and grip stretch wrap to facilitate the start of stretch wrapping. As shown by FIG. 3, hooks 140 are located such that upon insertion of insert portion 138 into seam 48 (or between container 22 and pallet 24), hooks 140 project beyond the sides of stack 21 for reception of shrink wrap. In other implementations, hooks 148 may be omitted.

In the example implementation illustrated, locator 128 is formed from a single panel or sheet of material with all of the structures extending in a single plane. In the example illustrated, locator 128 may be formed from material such as paper board, die cut plastic, injection molded plastic, metal, wood or bamboo. In other implementations, locator 128 may be formed from multiple pieces which are fastened, bonded, welded or otherwise joined to one another.

Figure 7:
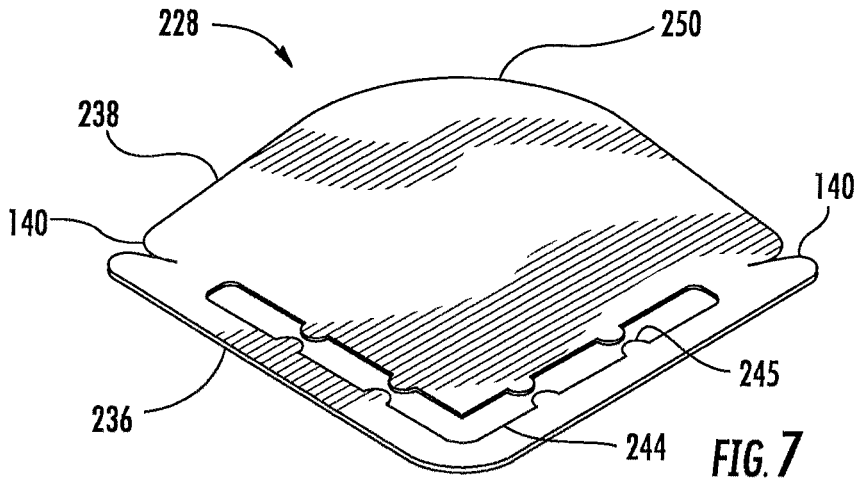
FIG. 7 is a perspective view of an example corner board locator of the corner protection system of FIG. 1.
Figure 8:
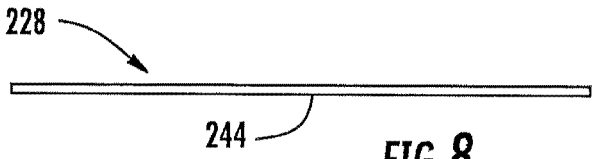
FIG. 8 is a sectional view of the locator of FIG. 7.
Figure 9:
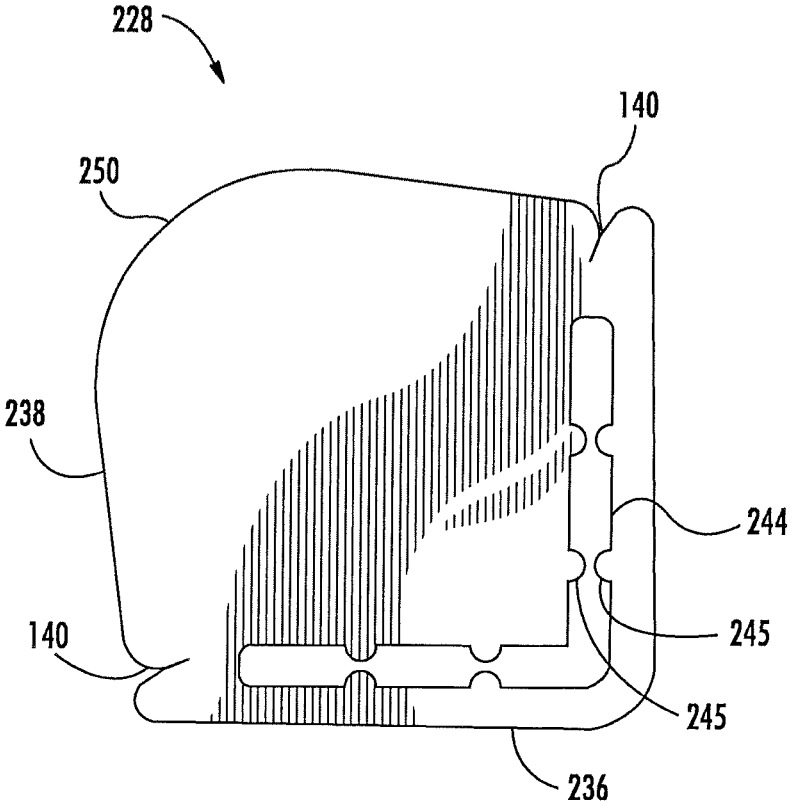
FIG. 9 is a top view of the locator of FIG. 7.

FIGS. 7-9 illustrate locator 228, another example implementation of locators 28 shown in FIGS. 1-3. Locator 228 is used in a similar fashion as locators 28 and 128. Locator 228 comprises a connector portion 236, insertion portion 238 and hooks 140. Connection portion 236 is similar to connection portion 136 except that connection portion 236 comprises slot 244 and teeth 245 in place of slot 144. Like slot 44 and slot 144, slot 244 is configured to slidably receive a cross-section of corner board 26.

Teeth 245 comprise a projection that extend or project into slot 244. Although such teeth 245 are illustrated as having a rounded and or tips, in other implementations, teeth 245 can be jagged, rectangular or pointed. Teeth 245 are configured to resiliently flex during insertion and sliding movement of corner board 26 through slot 244. Once corner board 26 is in position at a desired location, teeth 24 resiliently return towards their default or original position to grip or bite into corner board 26 to resist accidental or inadvertent sliding movement of locator 238 with respect to corner board 26. In one implementation, those portions of locator 228 from which teeth 245 project may also be configured to resiliently flex during insertion or movement of corner board 26. In other implementations, such portions of locator 228 adjacent to teeth 245 may have a greater overall stiffness as compared to such teeth 245.

Insertion portion 238 is similar to insertion portion 38 and 138 except that insertion portion 238 has a rounded tip 250. Rounded tip 250 provides additional stiffness (as compared to a more pointed tip 50) to facilitate insertion of locator 228 into seam 48 or between a lower most container 22 and pallet 24. As of locator 128, locator 228 may be formed from material such as paper board, die cut plastic, injection molded plastic, metal, wood or bamboo. In other implementations, locator 228 may be formed from multiple pieces which are fastened, bonded, welded otherwise joined to one another.

Figure 10:
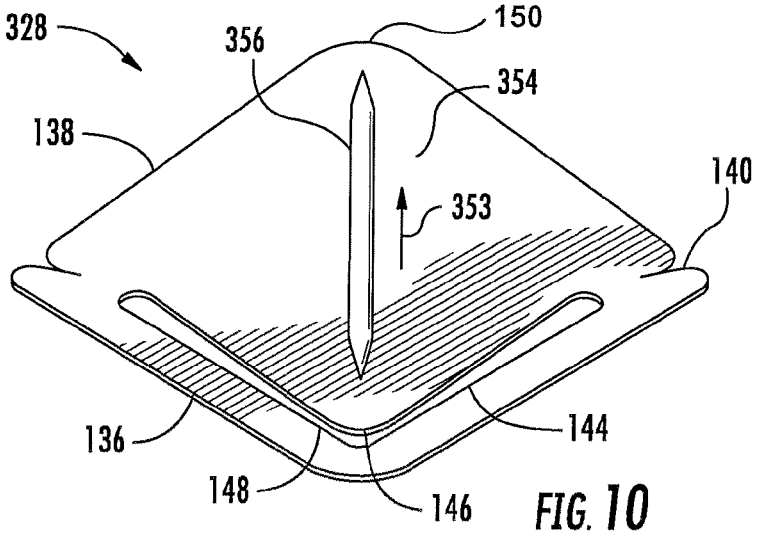
FIG. 10 is a perspective view of an example corner board locator of the corner protection system of FIG. 1.
Figure 11:
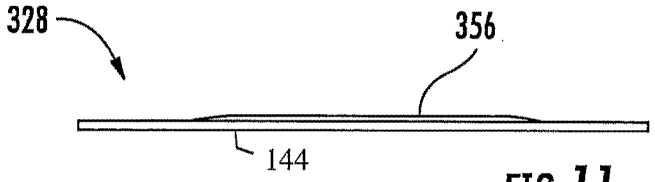
FIG. 11 is a side view of the locator of FIG. 10.
Figure 12:
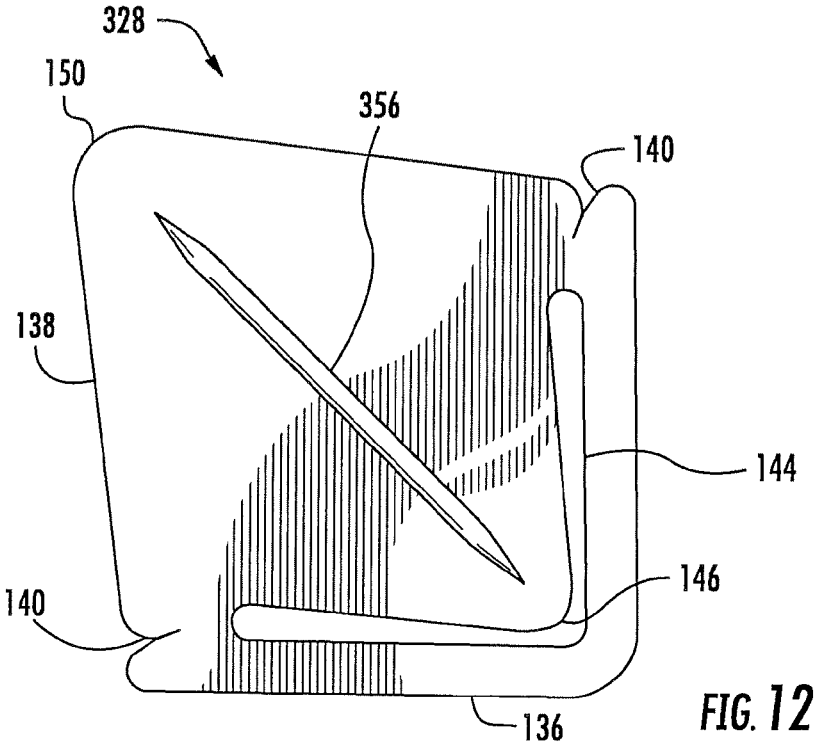
FIG. 12 is a top view of the locator of FIG. 10.

FIGS. 10-12 illustrate locator 328, another example implementation of locator 28. Locator 328 is similar locator 128 except that locator 338 additionally comprises antiskid face 354 portion 138. Antiskid face 354 comprises a surface characteristic which offers enhanced resistance to relative horizontal movement between insert portion 138 of locator 328 and the overlying (or underlying) container 22 in contact with antiskid face 354. In the example illustrated, antiskid face 354 comprises one or more lines 356 of fugitive glue which have a greater coefficient of friction with respect to the underlying or overlying container 22 as compared to those surfaces of insertion portion 138 about lines 356.

In other implementations, antiskid face 354 may have other configurations to resist accidental or inadvertent movement of insert portion 138 relative to an underlying or overlying container 22 in stack 21 (shown in FIG. 1). For example, in other implementations, the one or more lines 356 may be formed from other materials such as polymers or cellulose materials. Although a single line 356 is illustrated, in other implementations, multiple lines 356 (either aligned, intersecting, staggered or jagged) (similar to treads) may be provided. Additionally, stylistic patterns 356 of any complexity may be printed, molded, or otherwise adhered to antiskid face 354. Although line 356 is illustrated as extending parallel to an insertion direction 353 for locator 338, extending from point 146 towards point 150, in other implementations, the one or more lines 356 may alternatively extend perpendicular to the insert direction 353 or may extend at other angles relative to insert direction 353. In other implementations, antiskid face 354 may comprise a roughened surface with grits (similar to sandpaper) to provide a greater coefficient of friction with respect to an adjacent container 22. Although locator 328 is illustrated as having one antiskid face 354, in other implementations, both the upper surface and a lower surface of insert portion 138 may be provided with antiskid face 354. For example, the one or more lines 356 may be provided on both the upper surface and the lower surface of insert portion 138 for frictional engagement with containers 22 both above and below insert portion 138.

Figure 13:
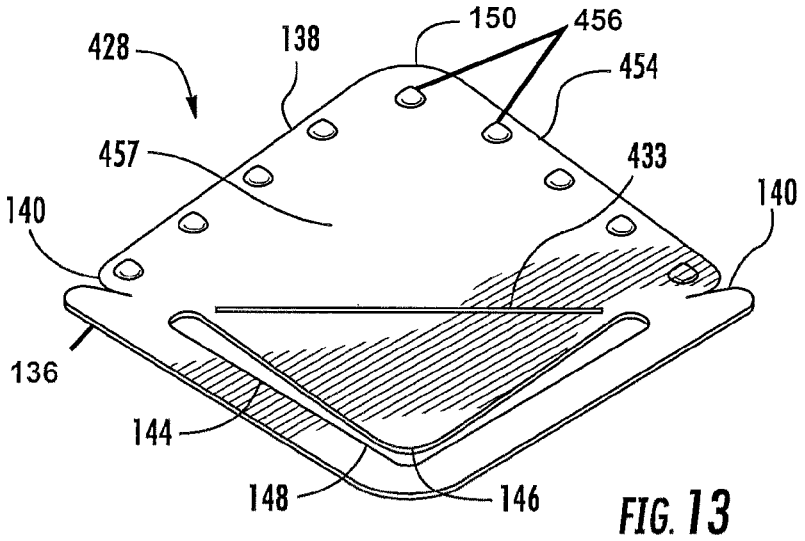
FIG. 13 is a perspective view of an example corner board locator of the corner protection system of FIG. 1.
Figure 14:
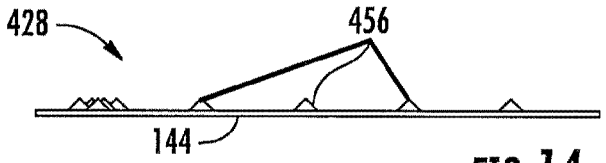
FIG. 14 is a sectional view of the locator of FIG. 13.
Figure 15:
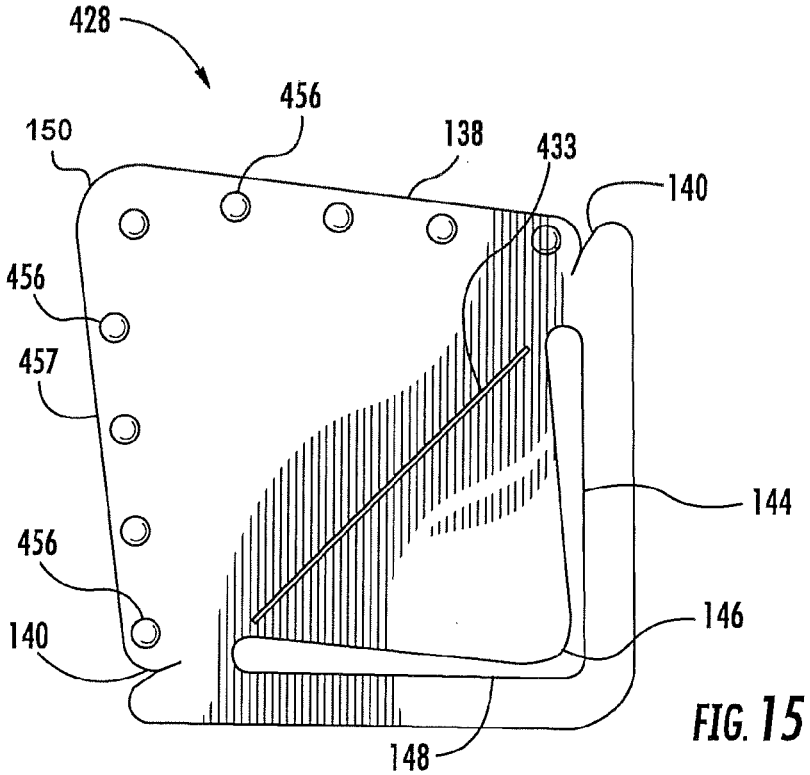
FIG. 15 is a top view of the locator of FIG. 13.

FIGS. 13-15 illustrate corner board locator 428, another example implementation of corner board locator 28 shown in FIGS. 1-3. Corner board locator 428 is used in a similar fashion to corner board locator 28. Corner board locator 428 is similar to corner board locator 128 except that corner board locator 428 additionally comprises hinge 433 and antiskid face 454. The remaining components of locator 428, which correspond to components of locator 128, are numbered similarly.

Hinge 433 comprises a structure which facilitates pivoting of point 146. In one example, hinge 433 comprises a crease, serration, groove or score forming a weakened region or line between point 146 and a central portion 457 of insertion portion 138. This weakened region facilitates pivoting of point 146 during sliding of corner board 26 through slot 144. In one implementation, portions of locator 428 proxy point 146 may be rigid. In other implementations, portions of locator 428 may be resiliently flexible so as to bend (in addition to the bending or pivoting about hinge 433) in response to corner board 26 sliding through slot 144. In other implementations, hinge 433 may comprise a living hinge that is molded rather than being formed by material removal processes such as die cutting or scoring.

Antiskid face 454 comprises a surface characteristic which offers enhanced resistance to relative horizontal movement between insert portion 138 of locator 428 and the overlying (or underlying) container 22 in contact with antiskid face 454. In the example illustrated, antiskid face 454 comprises a series of spaced proturberances or projections 456. Such projections 456 increase a level of resistance against sliding movement of insert portion 138 relative to an underlying and/or overlying container 22. In the example illustrated, projection 456 may be formed by embossing or debossing the panel forming insert portion 138 so as to project up and/or down. For example, in one implementation, embossments and debossments may be formed on opposite surfaces of insert portion 138 to form projections 456 projecting in opposite directions to provide locator 428 with an antiskid face 454 on both opposite surfaces of insert portion 138. In other implementations, projections 456 may be molded as part of locator 428 or bonded, welded or otherwise adhered to insert portion 138.

Figure 16:
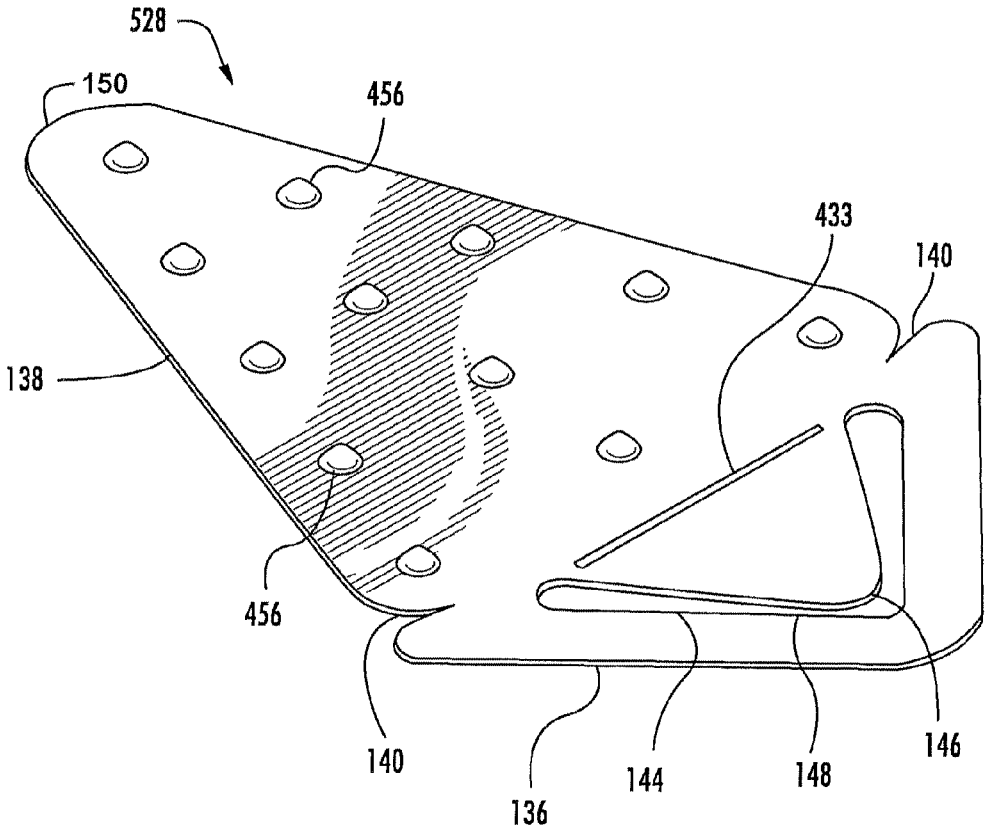
FIG. 16 is a perspective view of another example of the locator of FIG. 13.

In the example illustrated, projections 456 are arranged in lines or rows along insertion portion 138 of central portion 457. In other implementations, projections 456 may have other arrangements on the surface of central portion 457. For example, projections 456 may be arranged in other rows or may be arranged randomly across the surface of insert portion 138. For example, FIG. 16 illustrates locator 528, an alternative implementation of locator 428 with an alternative arrangement of projections 456. Although illustrated as circular dimples or pointed cones, projections 456 may have other shapes and sizes. Although illustrated as extending on a single surface of insert portion 138, projections 456 may alternatively extend upon both opposite surfaces of insert portion 138.

Figure 19:
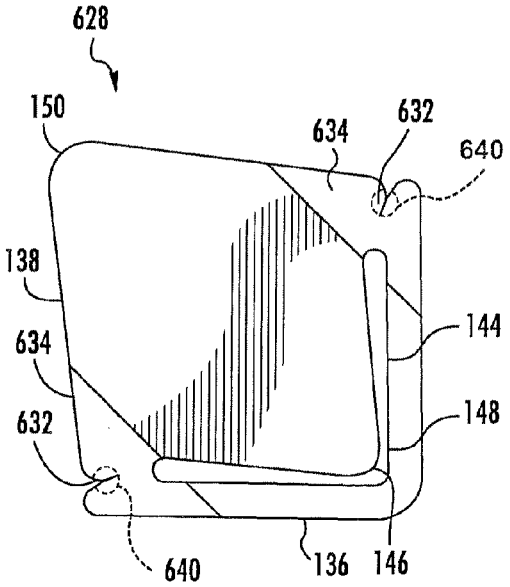
FIG. 19 is a top view of the locator of FIG. 13.
Figure 20:
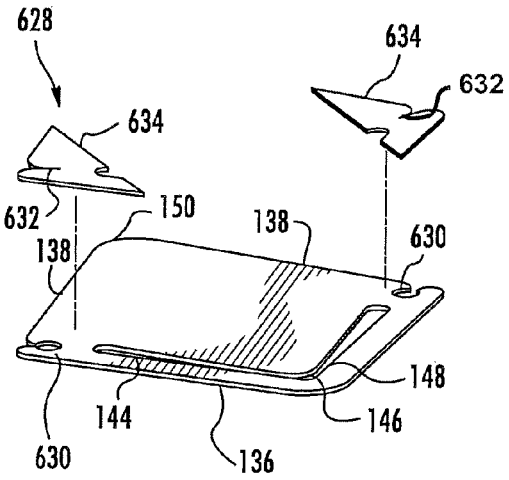
FIG. 20 is an exploded perspective view of the locator of FIG. 17.

FIGS. 17-20 illustrate corner board locator 628, another example implementation of locator 28. Corner board locator 628 is configured to be used in a fashion similar to corner board locator 28. Corner board locator 628 is similar to corner board locator 128 except that corner board locator 628 comprises hooks 640 in lieu of hooks 140. Hooks 640 are each formed as a multi-piece construction. As shown by FIG. 20, each hook 640 comprises a base opening, cut out, indentation or notch 630 and a slit 632 formed in a supplemental layer 634. Notch 630 comprises an opening extending into the single panel or sheet forming insert portion 138. Although notch 630 is illustrated as being circular, in other implementations, notch 630 may have other shapes.

Slit 632 overlies or extends opposite to notch 630 so as to form a narrow mouth through which stretch wrap may be inserted into notch 630. Slit 632 is formed as part of resiliency supplement layer 634. In the example illustrated, resiliency supplement layer 634 is formed from a material and/or has a thickness or configuration so as to have a greater resiliency as compared to insert portion 138 and those portions of insert portion 138 extending about notch 630. The greater resiliency facilitates improved retention and capturing of stretch wrap. In one implementation, supplemental layer 634 is formed from one or more polymers or plastics. In one implementation, the single panel or sheet forming insert portion 138 comprises a thick paperboard which is inexpensive, sturdy and easy to recycle. At the same time, supplemental layer 634, formed from one or more polymers, offers greater resiliency for enhanced stretch wrap capture. In one implementation, supplemental layers 634 are bonded, glued, fastened or otherwise adhered to the main panel forming insert portion 138.

Figure 17:
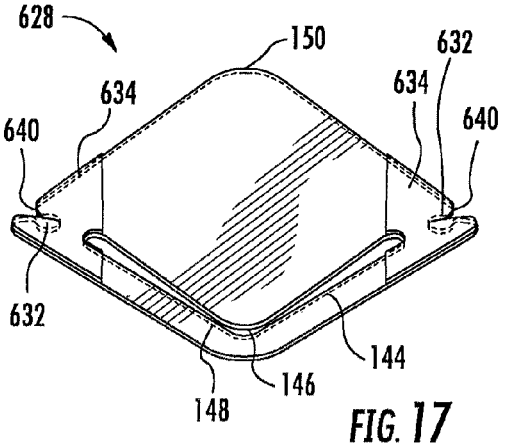
FIG. 17 is a perspective view of an example corner board locator of the corner protection system of FIG. 1.
Figure 18:
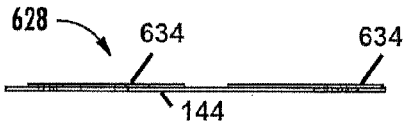
FIG. 18 is a sectional view of the locator of FIG. 13.

Although supplemental layers 634 are illustrated as being laminated or otherwise bonded to insert portion 138 adjacent to notches 630 on a single surface of insert portion 138, in other implementations, additional supplemental layers 634 may be laminated to the main panel of insert portion 138 on an opposite surface of insert portion 138 such that notch 630 is sandwiched between two opposing supplemental layers 634. Also, FIGS. 17 and 19 show supplemental layers 634—to be two separate bodies, but in other implementations supplemental panel 634 could be manufactured as a single body that contains two or more slits 632 and extends around or adjacent to slot 144.

Figure 22:
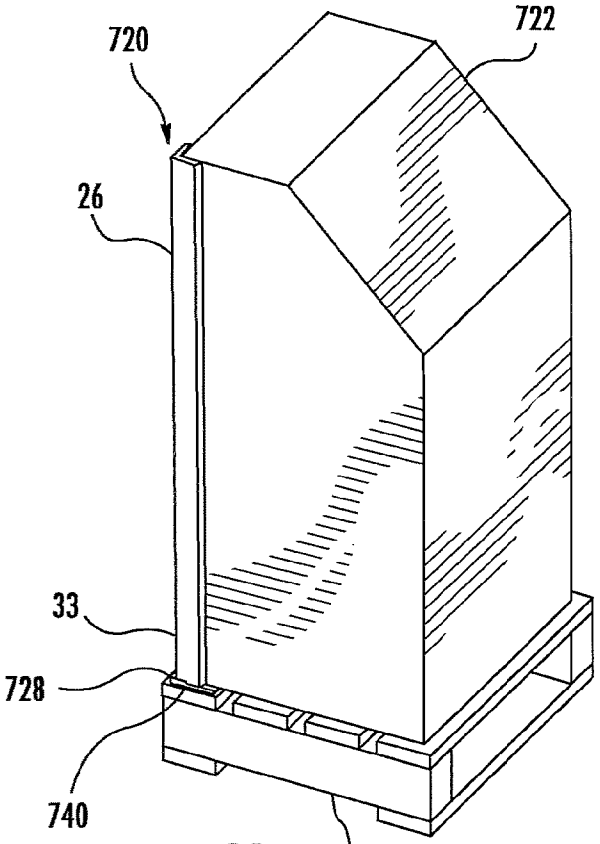
FIG. 22 is a perspective view of the corner protection system of FIG. 21 positioned on the example container.
Figure 21:
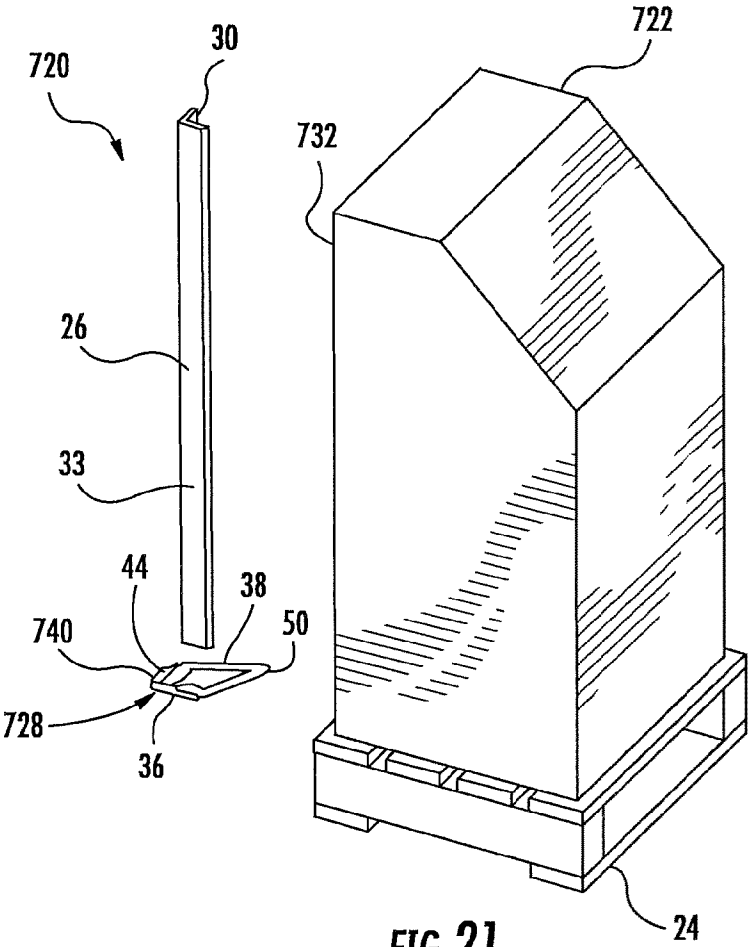
FIG. 21 is a perspective view of an example corner protection system for use with a container.
Figure 23:
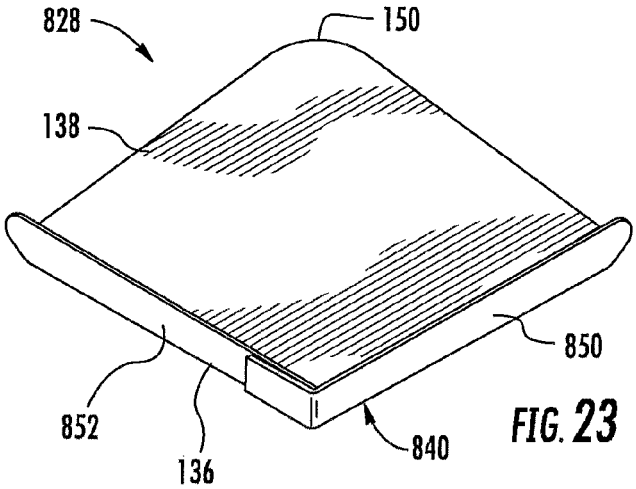
FIG. 23 is a perspective view of an example corner board locator of the corner protection system of FIG. 21.
Figure 24:
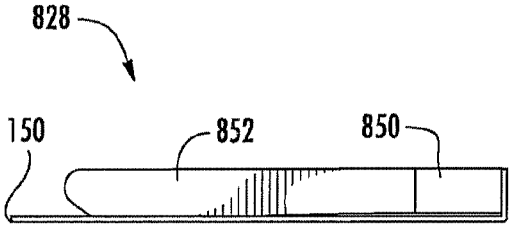
FIG. 24 is a front view of the locator of FIG. 23.
Figure 25:
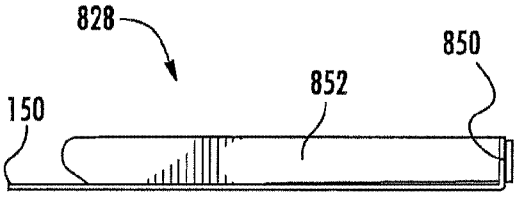
FIG. 25 is a left view of the locator of FIG. 23.
Figure 26:
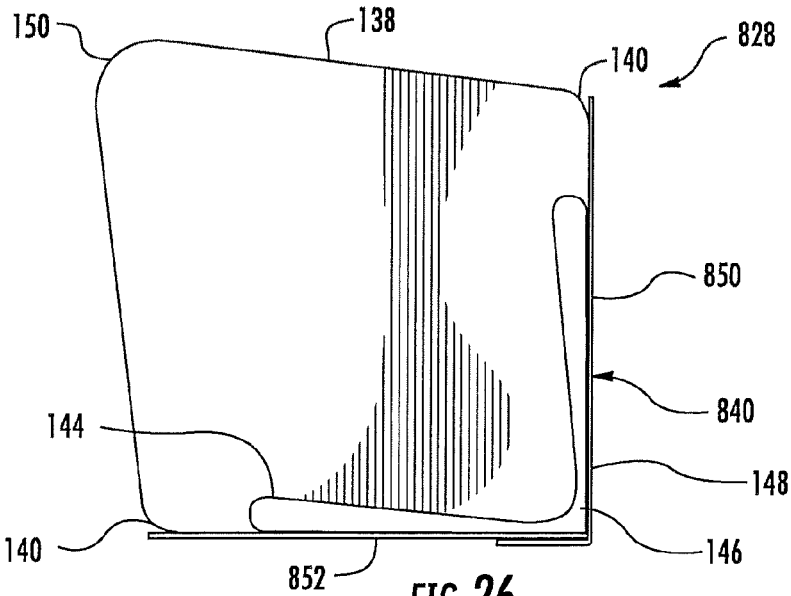
FIG. 26 is a top view of the locator of FIG. 23.
Figure 27:
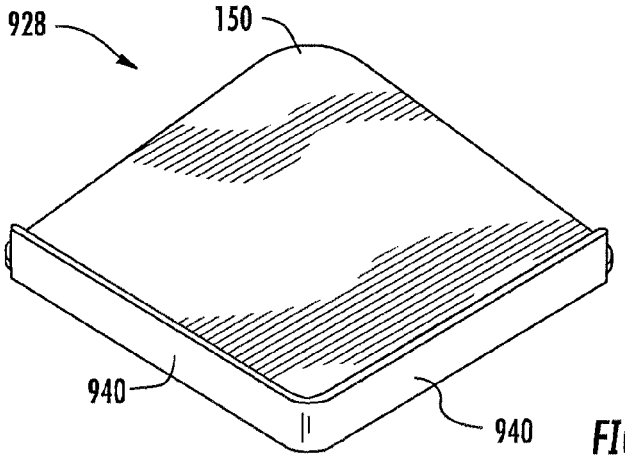
FIG. 27 is a perspective view of an example corner board locator of the corner protection system of FIG. 21.
Figure 28:
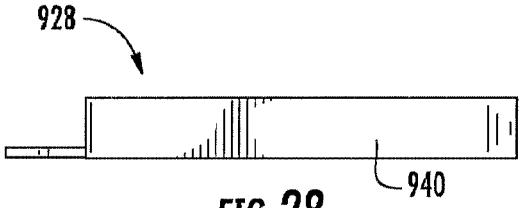
FIG. 28 is a front view of the locator of FIG. 27.
Figure 29:
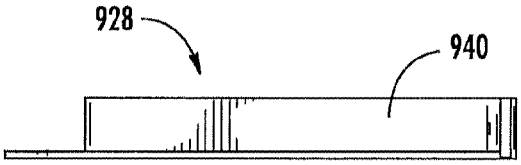
FIG. 29 is a rear view of the locator of FIG. 27.
Figure 30:
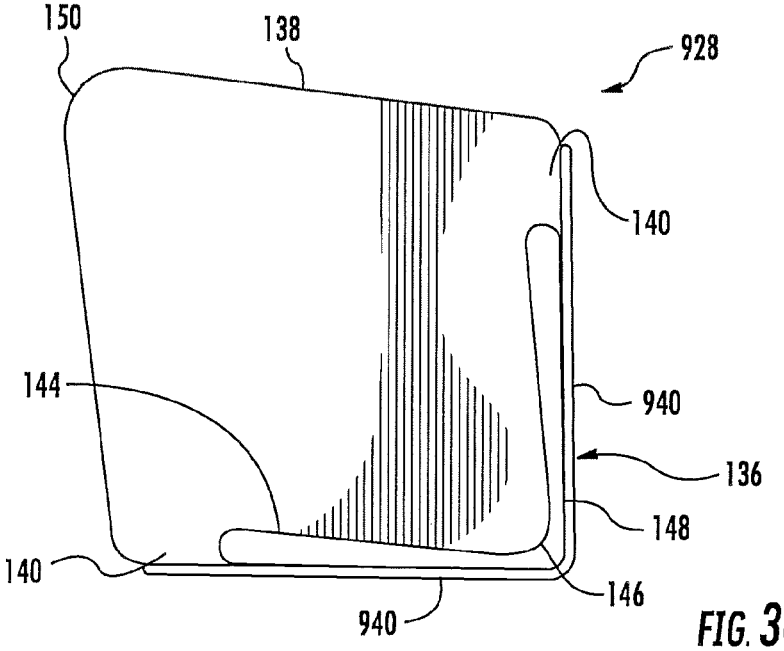
FIG. 30 is a top view of the locator of FIG. 27.
Figure 31:
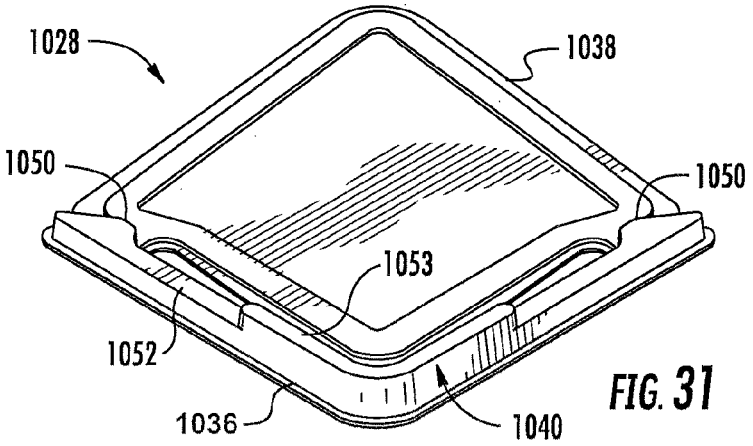
FIG. 31 is a perspective view of an example corner board locator of the corner protection system of FIG. 21.
Figure 32:
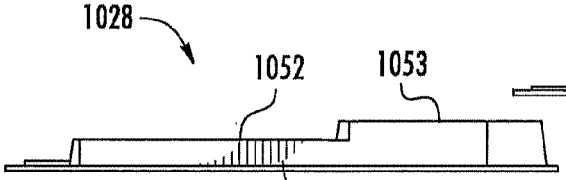
FIG. 32 is a front view of the locator of FIG. 31.
Figure 33:
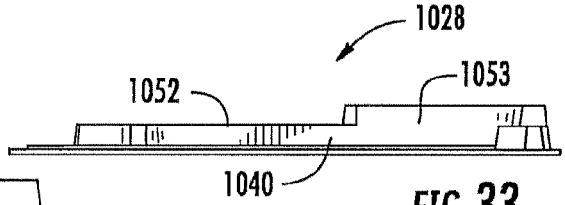
FIG. 33 is a rear view of the locator of FIG. 31.
Figure 34:
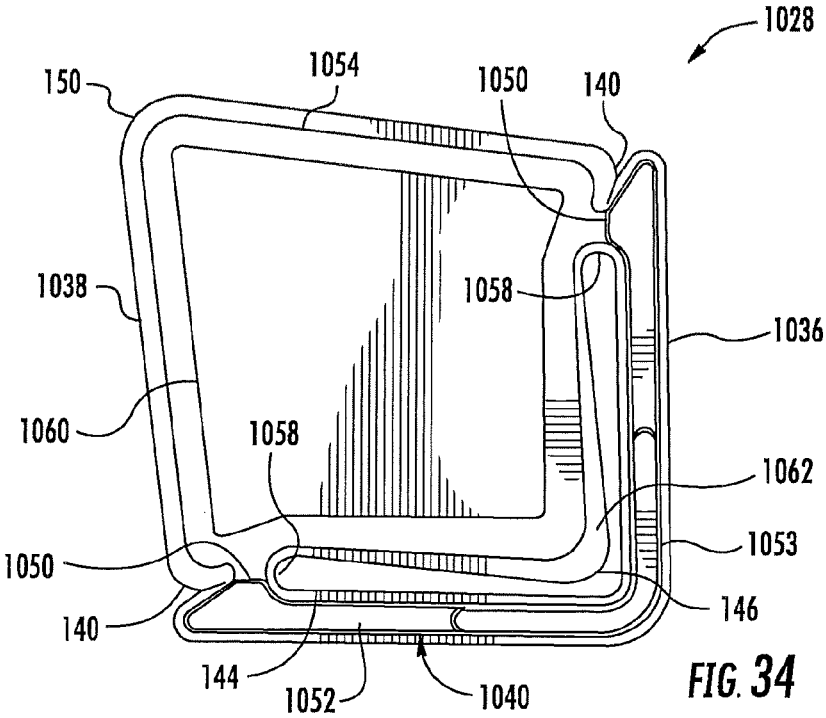
FIG. 34 is a top view of the locator of FIG. 31.
Figure 35:
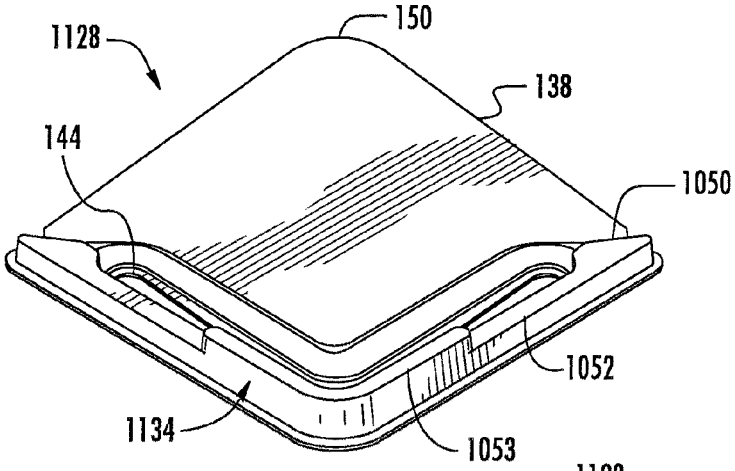
FIG. 35 is a perspective view of an example corner board locator of the corner protection system of FIG. 21.
Figure 37:
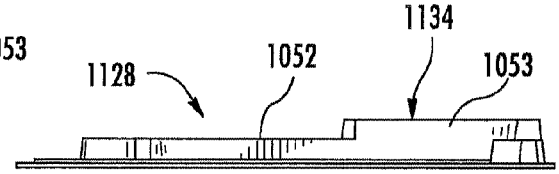
FIG. 37 is a rear view of the locator of FIG. 35.
Figure 36:
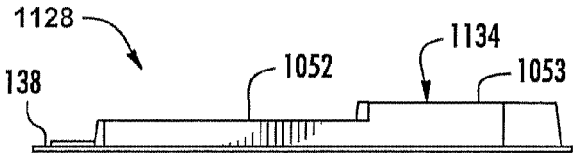
FIG. 36 is a front view of the locator of FIG. 35.
Figure 38:
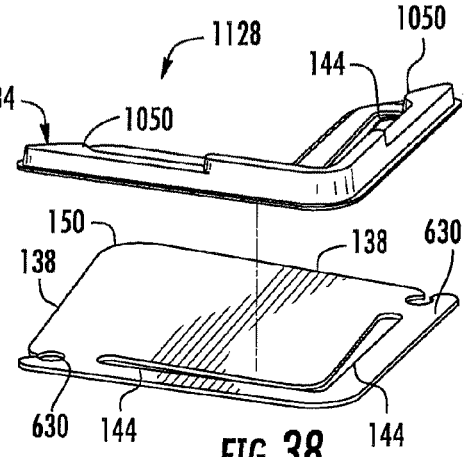
FIG. 38 is an exploded perspective view of the locator of FIG. 35.
Figure 39:
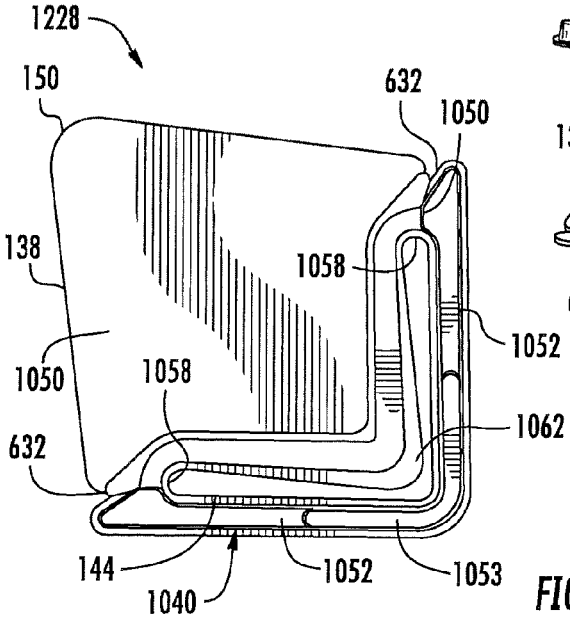
FIG. 39 is a top view of the locator of FIG. 35.

FIGS. 21 and 22 illustrate corner protection system or corner protector 720 for use with a container 722 resting upon a pallet 24. Container 722 may comprise a single package, article, product, furniture, retail display, assembly and the like. Container 722 may also comprise a wrapped palletized stack of multiple containers (such as shown in FIGS. 1 and 2). Many familiar with the practice of placing corner boards at the corners of a palletized load know that, in some situations, corner boards contribute substantially to the stacking strength or stability of a palletized load. Some may also find it difficult, because of a load's size or shape or some other factor, to ensure that corner boards stay in place during transit, even after the corner boards have been bound to the load and/or pallet with stretch wrap or banding. Often tape, adhesives, or other fasteners cannot be used to hold a corner board to a load because such methods would cause unacceptable damage to or leave unacceptable marks on the surface of a load. In some cases, significant stacking strength or stability is lost because the bottom of a single corner board is displaced from its original location on the top surface of a pallet. Corner protector 720 protects the corners of such items resting upon a pallet 24 and for which it is desirable to protect the corners thereof. Corner protector 720 protects the corners of the container 722 during shipment, storage and display. As will be described hereafter, corner board locator 728 reliably and securely locates and retains the bottom of corner board 26 with respect to container 722 after shrink wrapping or strapping of container 722 on pallet 24. As compared to corner protector 20 including and utilizing any of the variations of locator 28 described above, corner protector 720 better facilitates retention of the bottom of corner board 26 in the absence of seams 48. Corner protector 720 may more reliably support corner board 26 while being positioned at a bottom of container 722 between container 722 and pallet 24.

Corner protector 720 comprises corner board 26 (described above) and corner board locator 728. Corner board locator 728 is similar to locator 28 (as well as the other variations of locator 20 described above) except that locator 728 additionally comprises a raised or upstanding wall 740. Those remaining components of locator 728 which correspond to components of locator 28 are numbered similarly. As with locator 28 (or any of the other variations of locator 28 described above), locator 728 may be formed from a variety of materials such as paperboard, non-paperboard cellulose-based material, die cut plastic, injection molded plastic (polymers), thermoformed plastic, metal, wood and bamboo.

Wall 740 comprises at least one wall adjacent to and along the edges or opening of slot 44 along an outer side of slot 44, on an opposite side of slot 44 with respect to tip 50 and insert portion 38. In the example illustrated, wall 740 continuously extends along slot 44. In other implementations, wall 740 comprises multiple spaced wall portions or tabs spaced along slot 44. In one implementation, wall 740 is a height above slot 44 at the corner of slot 44 of at least 0.1 inch (2.54 millimeters) and nominally 0.75-1.25 inch (19.05-31.75 millimeters) to assist in supporting corner board 26. In other implementations, wall 740 may have other heights. In some implementations, internal surfaces of wall 740 may include prongs or spikes which further engage outer surfaces of corner board 26 to assist in retaining corner board 26.

FIG. 22 illustrates use of corner protector 720 to protect corner 732 of container 722. In use, locator 728 surrounds the bottom of corner board 26 at the bottom of container 722 above pallet 24. In particular, slot 44 receives a lower edge cross-section of corner board 26 while insert portion 38 extends below and is in contact with an underside of container 722 between container 722 and pallet 24. At the same time, wall 740 projects upwardly from slot 44 along the outer right angle faces 33 of corner board 26 to inhibit inadvertent displacement of corner board 26 away from corner 732 and, in some cases, to assist in propping corner board 26 up in a vertical orientation. In the example illustrated, slot 44 extends completely through locator 728, allowing locator 728 to be slid upward and downward along corner board 26 for those circumstances where locator 728 is to be used with a stack of containers (such as shown in FIGS. 1 and 2) wherein insert portion 38 of locator 728 is inserted into a seam 48 between adjacent containers 22. In another implementation, slot 44 does not extend through locator 728, in which case locator 728 supports the bottom of corner board 26 but locator 728 is limited to only being placed between the bottom of container 722 and pallet 24.

FIGS. 23-26 illustrate locator 828, an example implementation of locator 728. Locator 828 is similar to locator 128 except that locator 828 additionally comprises wall 840. Those remaining elements or components of locator 828 which correspond to components of locator 28 are numbered similarly. Wall 840 extends upwardly along a front edge of slot 144. In the example illustrated, wall 840 is formed as a single unitary body (a homogeneous structure) with insert portion 138. In the example illustrated, wall 840 is formed by upwardly bending tabs or flap portions 850, 852 of the single panel forming locator 828 adjacent to slot 144 and securing flap portions 850, 852 to one another (bonding, welding, fastening, interlocking and the like) to form a substantially right angle wall 840. In one implementation, locator 828 is formed from a single part or piece die cut from a flat sheet of material (paperboard, die cut plastic, injection molded plastic, metal and the like), wherein scoring utilized to assist in the formation of flaps 850, 852. In other implementations, wall 840 may formed in other fashions.

FIGS. 27-30 illustrate locator 928, an example implementation of locator 728. Locator 928 is similar to locator 828 except that locator 928 includes upstanding walls 940 in place of walls 840. Walls 940 are identical to walls 840 but the walls 940 are injection molded as part of insert portion 138. As a result, locator 928 may be more easily fabricated and walls 940 may be more strongly supported.

FIGS. 31-34 illustrate locator 1028, another example implementation of locator 728. Locator 1028 comprises a connector portion 1036 and insertion portion 1038. Connector portion 1036 is similar to connector portion 136 of locator 928 except that connector portion 1036 comprises wall 1040 in lieu of wall 940. Wall 1040 comprises retention portions 1050, lower plateau 1052 an upper plateau 1053. In other implementations, a single plateau or upper surface caps wall 1040. Retention portions 1050 comprise portions of wall 1040 which at least partially wrap about ends 1058 of slot 144. Retention portions 1050 assist in securing and aligning corner board 26. Retention portions 1050 further serve to add additional stiffening strength to wall 1040.

Lower plateau 1052 extends from retention portions 1050 to upper plateau 1053. Lower plateau 1052 provides a first level of stiffness and support along corner board 26. Upper plateau 1053 extends between portions of lower plateau 1052 and rises above lower plateau 1052 opposite point 150 at point 146 at the corner of slot 144. Upper plateau 1053 provides a greater degree of stiffness and support for corner board 26 at the corner of corner board 26. In some implementations, plateaus 1052, 1053 may be omitted.

Insertion portion 1038 is similar to insertion portion 138 except that insertion portion 1038 includes additional form geometries 1060 and flexible tab 1062. Geometries 1060 comprise channels, walls, embossments, debossments and the like. Such geometries 1060 provide additional stiffening to insertion portion 1038 and will also provide insertion portion 1038 with an antiskid face 1054. The additional stiffening provided by geometry 1060 provides locator 1028 with sufficient strength facilitating formation of locator 1028 from a sheet of thermoplastic material or molded pulp paperboard. In other implementations, locator 1028 may be formed from other materials and may be formed in other fashions.

Flexible tab 1062 comprises an inner edge of slot 144 having an enhanced degree of flexibility and resiliency as compared to adjacent portions of connector portion 1038. Flexible tab 1062 resiliently flexes or bends during sliding movement of corner board 26 through slot 144 and is resiliently urged against the inserted corner board 26 to grip or pinch against the inserted corner board 26 to assist in retaining the inserted corner board 26 in a desired location along corner board 26. In the example illustrated, flexible tab 1062 continuously extends along the inner edge of slot 144 between slot 144 and point 150. In other implementations, flexible tab, 62 may comprise a plurality of spaced flexible tabs spaced along the inner edge of slot 144. In other implementations, flexible tab 1062 may be omitted.

FIGS. 35-39 illustrate locator 1128, another example implementation of locator 728. Locator 1128 is similar to locator 628 except that locator 1128 comprises supplemental mount 1134 in lieu of supplemental layers 634. Supplemental mount 1134 is mounted to the separate main panel forming slot 144, notches 630 and insertion portion 138. Supplemental mount 1134 is similar to wall 1040 of locator 1028 except that supplemental mount 1134 additionally comprises slits 632. Those remaining components of mount 1134 which correspond to components of locator 1028 as well as locator 628 are numbered similarly. As with slits 632 of locator 628, slits 632 of locator 1128 overly or extend opposite to notch 630 so as to form a narrow mouth through which stretch wrap may be inserted into notch 630. Slit 632 is formed as part of supplemental mount 1134. In the example illustrated, mount 1134 is formed from a material and/or has a thickness or configuration so as to have a greater resiliency as compared to insert portion 138 and those portions of insert portion 138 extending about notch 630. The greater resiliency facilitates improved retention and capturing of stretch wrap. In one implementation, supplemental layer 634 is formed from one or more polymers or plastics. In one implementation, the single panel or sheet forming insert portion 138 comprises a thick paperboard which is inexpensive, sturdy and easy to recycle. At the same time, mount 1134, molded or otherwise formed from one or more polymers, offers greater strength for wall 1040 and further offers enhanced resiliency for slits 632 for enhanced stretch wrap capture. In one implementation, mount 1134 is bonded, glued, mechanically fastened or otherwise adhered to the main panel forming insert portion 138.

Although mount 1134 is illustrated as being laminated or otherwise bonded to insert portion 138 adjacent to notches 630 on a single surface of insert portion 138, in other implementations, additional supplemental layers 634 (described above with respect to locator 628) may be laminated to the main panel of insert portion 138 on an opposite surface of insert portion 138 such that notch 630 is sandwiched between opposing supplemental layer 634 and mount 1134.

Figure 41:
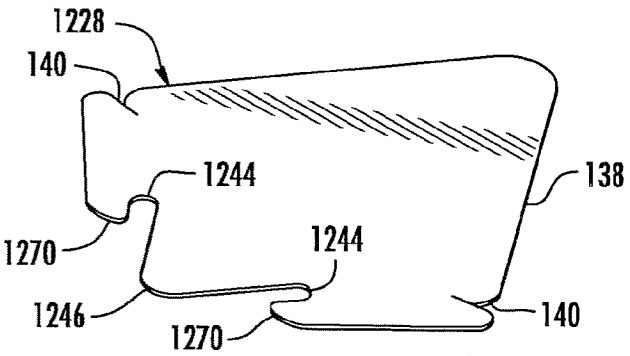
FIG. 41 is a perspective view of a locator of the corner protector of FIG. 40.
Figure 42:
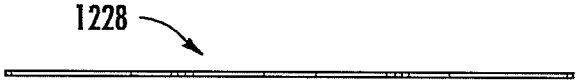
FIG. 42 is a side view of the locator FIG. 41.
Figure 40:
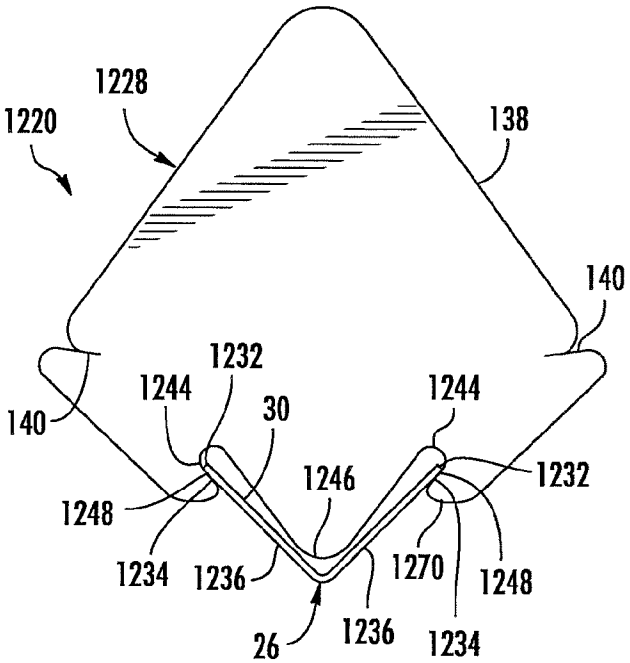
FIG. 40 is a top plan view of another example corner protector.

FIGS. 40-42 illustrate locator 1228, a particular example of locator 28 shown in FIGS. 1 and 2. FIG. 40 illustrates locator 1228 joined to corner board 26 to form corner protector 1220, another example of corner protector 20. FIGS. 40 and 41 illustrate locator 1228 independent of corner board 26. Similar to locator 128 described above, locator 1228 comprises insert portion 138 and hooks 140, each of which is described above with respect to locator 128. Unlike locator 128, locator 1228 comprises connection portion 1236. Connection portion 1236 similar to connection portion 136 except that connection portion 1236 comprises notches 1244 in lieu of the slit or slot 144.

Figure 45:
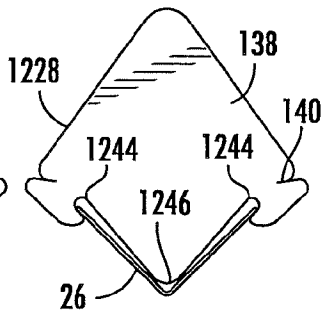
FIGS. 43-45 are top plan views of the locator of FIG. 40 in different sizes.
Figure 44:
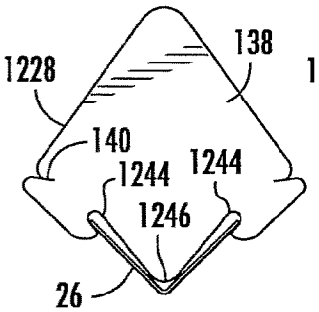
Figure 43:
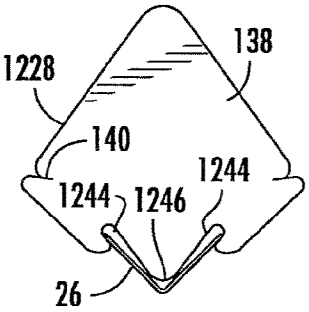

Notches 1244 comprise recesses, cut outs for detents extending into the edge of insert portion 138 of ocator 1228. Notches 1244 are sized, located and oriented to concurrently receive the two opposite longitudinal (and vertical when employed) longitudinal edges 1232 and end portions 1234 of panels or legs 1236 of corner board 26. In the example illustrated, notches 1244 extend an opposite sides of a point 1246, wherein point 1246 contacts a backside of corner board 26 while the front side of end portions 1234 contact the inwardly facing edges 1248 of notches 1244. Point 1246 indicates complete insertion of corner board 26 into notches 1244. Because point 1246 contacts or closely abuts the backside of corner board 26 while edges 1248 contact or closely abut the front side of corner board 26, corner board 26 is held in place with reduced movement while the same time, allowing notches 1244 to have mouths that are substantially wider than the thickness of corner board 26, facilitating easier insertion of corner board 26. In other implementations, point 1246 may be omitted or may be shortened such a not contact the backside of corner board 26. In other implementations, notches 1244 may alternatively contact both sides or faces of corner board 26 when corner board 26 is inserted within notches 1244. As shown by FIGS. 43-45, the size of locator 1228 and the configuration of notches 1244 and point 1246 may be varied to accommodate differently sized corner boards 26.

Figure 46:
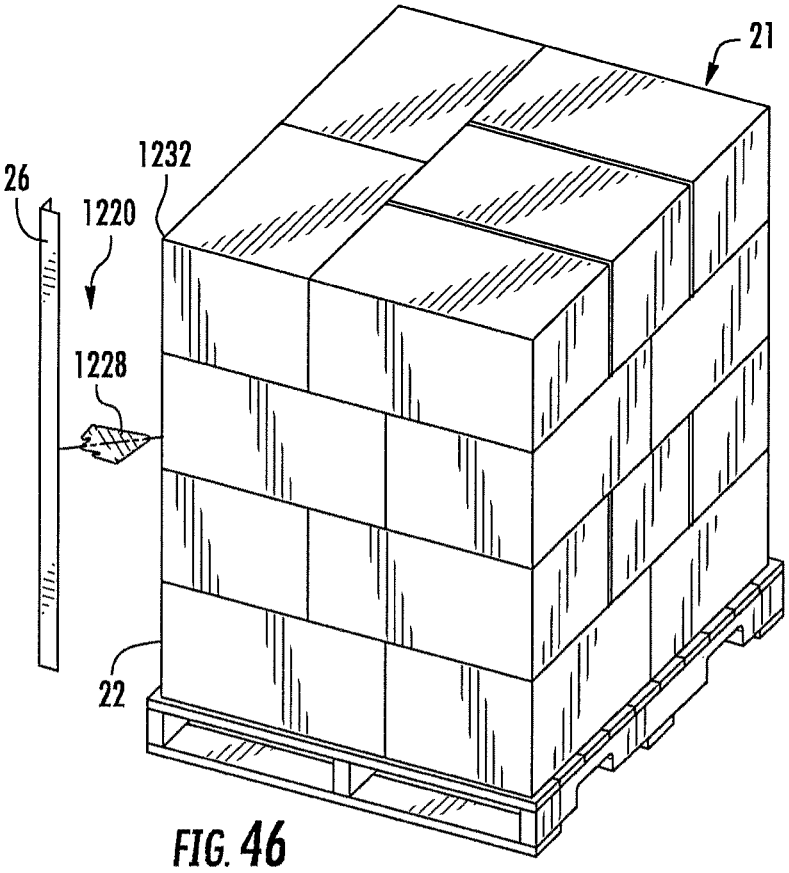
FIG. 46 is a perspective view of a stack in the corner protector of FIG. 40 prior to assembly.
Figure 47:
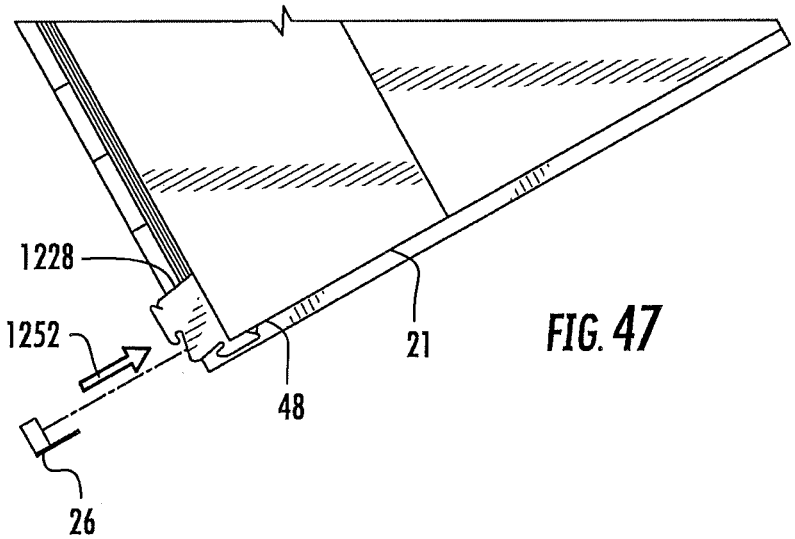
FIG. 47 is a top plan view of the stack of FIG. 46 during insertion of the locator.
Figure 48:
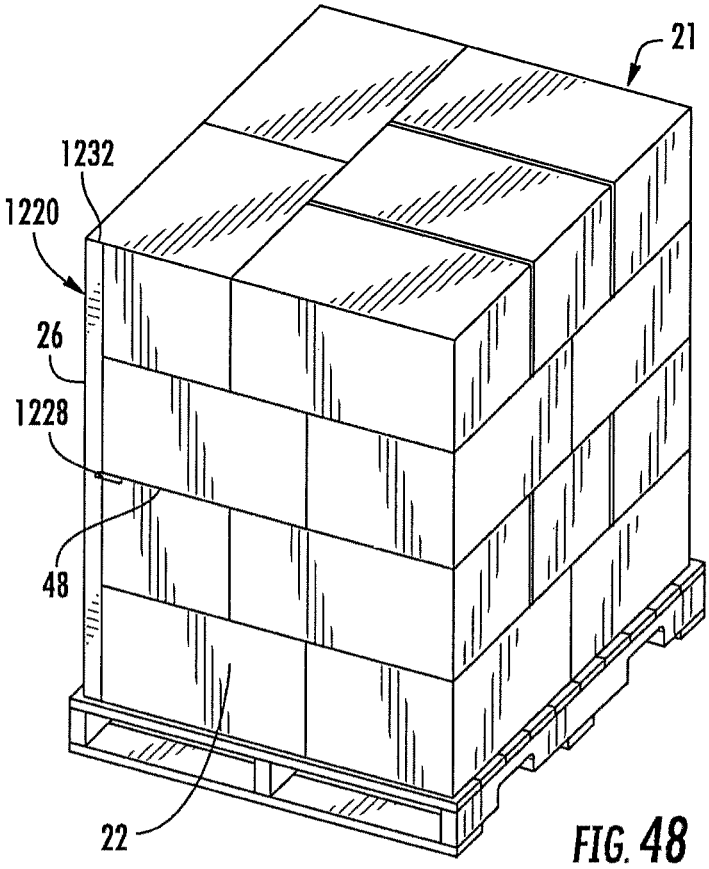
FIG. 48 is a perspective view of the assembled corner protector positioned on the stack.
Figure 49:
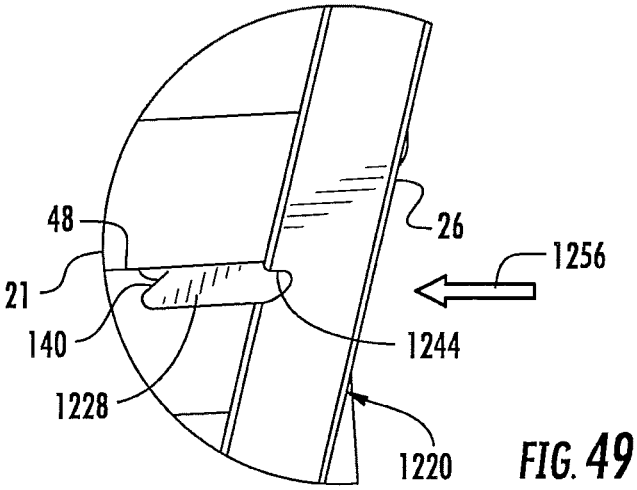
FIG. 49 is an enlarged view of the assembled corner protector and stack of FIG. 48.

FIGS. 46-49 illustrate an example use of locator 1228. As shown by FIGS. 46-49, notches 1244 facilitate easier connection of corner board 26 to locator 1228. As shown by FIGS. 46 and 47, locator 1228 is positioned and secured along corner board 26 at a selected height such that insertion portion 1238 will align opposite to seam 48 of stack 21. FIG. 47 illustrates insertion and movement of locator 1228 in the direction indicated by arrow 1252 into seam 48. As shown by FIG. 49, such insertion continues until substantially all of insert portion 1238 is inserted into seam 48 with hooks 140 and notches 1244 extending or projecting beyond sides of stack 21 outwardly beyond seam 48.

As shown by FIGS. 48 and 49, once locator 1228 has been properly position within seam 48, independent of corner board 26, corner board 26 is moved in a substantially horizontal direction (as indicated by arrow 1256) towards stack 21 until notches 1244 receives edges 1232. Because notches 1244 allow corner board 26 to be horizontally moved into connection with locator 1228 (rather than being slid through a slit or slot), locator 1228 may be more easily inserted into seam 48 (between tiers of the pallet load) independent of corner board 26. As a result, locator 1228 may be more easily position within seam 48 by shipping personnel or robots.

Insert portion 138 retains corner board 26 in place relative to corner 32 prior to stack 21 being wrapped with shrink film or being secured with strapping. Insert portion 138 further retains corner board 26 in place after the shrink wrapping or strapping has been removed. The weight of the overlying containers (also known as packages, cartons, boxes, bins, sub pallets, modules and the like) bearing down upon insertion portion 138 provide a friction hold inhibiting accidental or inadvertent withdrawal of insert portion 138. This retention is provided with minimal scratching or damaging of the containers 22.

Although corner protector 1220 has been described as comprising a single locator 1228 selectively positioned along corner board 26, in other implementations, corner protector 20 may include a plurality of locators 1228 along the length of corner board 26. For example, corner protector 1220 may include a first locator 1228 between pallet 24 and a lowermost container 22 of stack 21, a second locator 28 located above the uppermost container 22 of stack 21 and one or more additional locators 1228 inserted into different seams 48 of stack 21.

In the example implementation illustrated, locator 1228 is formed from a single panel or sheet of material with all of the structures extending in a single plane. In the example illustrated, locator 1228 may be formed from material such as paper board, die cut plastic, injection molded plastic, metal, wood or bamboo. In other implementations, locator 1228 may be formed from multiple pieces which are fastened, bonded, welded or otherwise joined to one another.

Although locator 1228 is illustrated as comprising insert portion 138 as shown and described above with respect to FIGS. 4-6, in other implementations, locator 1228 may comprise one or more of the additional features described above with respect to locators 228, 328, 428, 528, 628, 728, 828, 928, 1028 and 1128. For example, in another implementation, notches 1244 may additionally comprise teeth 245 of locator 228. In another implementation, insert portion 138 may additionally comprise an antiskid face 354 and/or line 356 of locator 328. In another implementation, locator 1228 may additionally or alternatively comprise projections 456 and/or hinge 433 of locator 428. In one implementation, locator 1228 may additionally or alternatively comprise supplemental layers 634 of locator 628, wherein such supplemental layers 634 not only strengthen or form hooks 140, but also strengthen and rigidify the outer hook portions 1270 on the outside of notches 1244. In one implementation, the outer hook portions 1270 may additionally carry wall 852 of locator 828 or wall 1052 of locator 1028.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A method comprising the steps of:

a) positioning a one piece, corner board locator having a connection portion, having an angled slot formed therein, and an insert portion, having a single continuous planar exterior edge with a tip and with first and second hooks formed on opposite ends thereof which are configured to receive and grip stretch wrap, on a corner board having two angled panels, said two angled panels engaging with said angled slot to retain said corner board locator at a select height along said corner board;

b) positioning said corner board and corner board locator adjacent to a stack of at least two vertically consecutive containers;

c) sliding said single continuous planar exterior edge of said insert portion between two of said at least two vertically consecutive containers to form a corner board protector; and d) positioning stretch wrap in at least one of said first and second hooks to facilitate wrapping said stack with stretch wrap.

2. The method of claim 1 further comprising an upstanding wall formed on said corner board locator.

3. The method of claim 1 wherein said insert portion projects from said corner board in a direction perpendicular to each of said two angled panels of said corner board.

4. The method of claim 1 wherein said insert portion has a thickness less than or equal to 0.25 inches and can be inserted between two vertically consecutive containers without tipping an overlying container.

5. The method of claim 1 further comprising positioning said insert portion between a lower most container and a pallet on which said lower most container is placed.

6. The method of claim 1 wherein said insert portion has a rounded tip which can be inserted between said stack of at least two vertically consecutive containers.

* * * * *